US006895861B2

(12) United States Patent
Price et al.

(10) Patent No.: US 6,895,861 B2
(45) Date of Patent: May 24, 2005

(54) KEYLESS INKING SYSTEMS AND METHODS USING SUBTRACTIVE AND CLEAN-UP ROLLERS

(75) Inventors: James F. Price, 1305 Johns Dr., Euless, TX (US) 76039-2628; Robert L. Goodman, Mesquite, TX (US); Max W. Dahlgren, Dallas, TX (US)

(73) Assignee: James F. Price, Euless, TX (US)

( * ) Notice: Subject to any disclaimer, the term of this patent is extended or adjusted under 35 U.S.C. 154(b) by 0 days.

(21) Appl. No.: 10/617,017

(22) Filed: Jul. 11, 2003

(65) Prior Publication Data

US 2005/0005790 A1 Jan. 13, 2005

(51) Int. Cl.[7] ..... B41F 31/00

(52) U.S. Cl. ..... 101/483; 101/350.4; 101/425; 101/367

(58) Field of Search ..... 101/363–367, 101/350.1, 350.3, 350.4, 350.5, 169, 138, 101/141, 142, 148, DIG. 39, 425, 144, 212, 101/216, 181, 351.4

(56) References Cited

U.S. PATENT DOCUMENTS

| | | | | |
|---|---|---|---|---|
| 2,285,052 A | | 6/1942 | Roesen | |
| 2,613,600 A | | 10/1952 | McWhorter | |
| 2,821,133 A | * | 1/1958 | Brodie | 101/350.1 |
| 2,986,088 A | | 5/1961 | Chase et al. | |
| 3,504,626 A | | 4/1970 | Worthington | |
| 3,587,463 A | | 6/1971 | Granger | |
| 3,611,924 A | | 10/1971 | Harrison | |
| 3,800,702 A | | 4/1974 | Roberts | |
| 3,842,735 A | * | 10/1974 | Southam | 101/425 |
| 4,040,348 A | | 8/1977 | Gertsch et al. | |
| 4,041,864 A | | 8/1977 | Dahlgren et al. | |
| 4,158,333 A | * | 6/1979 | Navi | 101/363 |
| 4,223,603 A | * | 9/1980 | Faddis et al. | 101/350.3 |
| 4,254,709 A | | 3/1981 | Arnolds | |
| 4,263,848 A | | 4/1981 | Matalia et al. | |
| 4,308,796 A | * | 1/1982 | Satterwhite | 101/351.4 |
| 4,373,442 A | | 2/1983 | Dahlgren et al. | |
| 4,373,443 A | * | 2/1983 | Matalia | 101/363 |

(Continued)

FOREIGN PATENT DOCUMENTS

DE 11 30 453 5/1962

(Continued)

OTHER PUBLICATIONS

J. W. Freeman; Letter re: U.S. Patent Appl. No. 2001/0032559, Oct. 25, 1991 "Inking Systems for Printing Presses"; letter dated Jan. 10, 2003; 4 pages of letter and 8 pages of enclosure bearing dates in Aug., 1995.

(Continued)

*Primary Examiner*—Eugene H. Eickholt
(74) *Attorney, Agent, or Firm*—Burns, Doane, Swecker & Mathis, L.L.P.

(57) ABSTRACT

Keyless inking systems and methods are disclosed which employs a main form roller and a smaller clean-up roller, both in contact with a rotating printing plate. Separate application and subtractive roller systems control the ink film on the form roller. The clean-up roller removes residual ink from non-image areas on the printing plate. The clean-up roller is in ink communication with the main form roller through a vibrating roller. Mechanisms are provided to selectively engage and disengage the various rollers.

24 Claims, 8 Drawing Sheets

U.S. PATENT DOCUMENTS

| | | | | |
|---|---|---|---|---|
| 4,404,908 | A * | 9/1983 | Simeth | 101/350.5 |
| 4,428,291 | A | 1/1984 | Dorow | |
| 4,432,282 | A * | 2/1984 | Jurinak | 101/169 |
| 4,453,463 | A | 6/1984 | Dahlgren et al. | |
| 4,493,257 | A | 1/1985 | Kubert et al. | |
| 4,497,250 | A * | 2/1985 | Dressler | 101/366 |
| 4,527,471 | A | 7/1985 | Dahlgren et al. | |
| 4,527,479 | A | 7/1985 | Dahlgren et al. | |
| 4,542,693 | A | 9/1985 | Mourrellone | |
| 4,685,414 | A | 8/1987 | DiRico | |
| 4,864,925 | A | 9/1989 | Van Kanegan et al. | |
| 5,033,380 | A | 7/1991 | Sonobe et al. | |
| 5,046,416 | A | 9/1991 | Freyer et al. | |
| 5,178,065 | A | 1/1993 | Reder et al. | |
| 5,178,678 | A | 1/1993 | Koehler et al. | |
| 5,218,905 | A | 6/1993 | Bolte et al. | |
| 5,259,313 | A | 11/1993 | Gibson et al. | |
| 5,315,930 | A | 5/1994 | Niemiro | |
| 5,355,796 | A | 10/1994 | Köbler et al. | |
| 5,355,799 | A | 10/1994 | Lutz | |
| 5,425,809 | A | 6/1995 | Person | |
| 5,452,660 | A | 9/1995 | Stein | |
| 5,540,149 | A | 7/1996 | Hoge | |
| 5,603,262 | A | 2/1997 | Uera et al. | |
| 5,709,147 | A | 1/1998 | Uera et al. | |
| 5,908,505 | A | 6/1999 | Bargenquest et al. | |
| 5,983,799 | A | 11/1999 | Lane, III et al. | |
| 6,006,664 | A | 12/1999 | Hummel et al. | |
| 6,006,665 | A | 12/1999 | Stuchlik et al. | |
| 6,055,907 | A | 5/2000 | Endisch et al. | |
| 6,065,402 | A | 5/2000 | Feller et al. | |
| 6,116,161 | A | 9/2000 | Voge et al. | |
| 6,409,645 | B1 | 6/2002 | Paasonen et al. | |

FOREIGN PATENT DOCUMENTS

| | | |
|---|---|---|
| DE | 44 24 581 | 10/1995 |
| JP | 61 106254 | 5/1986 |
| WO | WO 83/04003 | 11/1983 |
| WO | WO 00/51817 | 9/2000 |

OTHER PUBLICATIONS

Pamarco, Fiberlyte™ Carbon Fiber Anilox Rolls Are Now A Reality.

Karat Digital Press, Product Overview, The Next Tradition in Printing, (Karat Digital Press L.P.).

* cited by examiner

KEYLESS INKING SYSTEMS AND METHODS USING SUBTRACTIVE AND CLEAN-UP ROLLERS

FIELD OF THE INVENTION

The field of the invention is inking systems and methods for printing presses for uniformly applying ink and/or dampening solution to the printing plates and removing unwanted ink from the printing plates, especially from non-image areas.

BACKGROUND OF THE INVENTION

An offset printing press typically includes a plate cylinder carrying one or more printing plates. The printing plates have oleophilic surfaces defining an image area, and hydrophilic surfaces defining a non-image area. An inker applies ink to the printing plate which collects on the oleophilic surfaces to form an image which can be transferred to a blanket cylinder which transfers the image to media. Dampening solution may be applied to non-image areas. By transferring the image from the printing plate onto a blanket roller, and then onto the media, the printing plate does not directly print the image on the media, hence the term offset printing.

The inker applies ink carried on one or more form rollers to the printing plate. When the form roller in the inker engages the printing plate, the ink film on the form roller contacting image areas on the printing plate is split such that approximately one-half of the thickness of the ink film is applied to the image area of the printing plate leaving approximately one-half the ink on the form roller that never recovers its original ink film thickness on the printed, ink depleted areas causing a condition referred to as starvation. The ink film on the form roller contacting non-image areas on the printing plate remains on the form roller causing a condition called accumulation.

This combination of accumulation and starvation results in undesirable "ghosted" images and image repeats being formed on the final printed product. In order to minimize this problem, many conventional inkers include a plurality of form rollers (for example, four) which each apply a small amount.

The printed product is monitored to determine when ink density has degraded beyond an acceptable level. In order to control the quality of the printing, conventional printer inkers also include a plurality of adjustable keys to control the amount of ink being applied to the form roller. These keys require constant adjustment to maintain the quality of the printed product.

Keyless inking systems are generally known in the prior art. Some prior art keyless systems have attempted to solve "ghosting," starvation, and accumulation problems in keyless inking systems employing single or multiple form rollers. However, these solutions have not been completely successful in solving these problems.

U.S. Patent Publication No. US2001/0032559, to Price et al, published on Oct. 25, 2001, discloses "Inking Systems for Printing Presses." The content of this application is hereby incorporated by reference in its entirety. Embodiments disclosed in this patent publication include keyless inking systems with one relatively large form roller for applying ink to a printing plate. Ink is applied to the form roller by an applicator roller having an ink carrying surface and a variable speed drive. The form roller and plate cylinder are rotated at the same rpm while the speed of the applicator roller is varied to vary the amount of ink applied to the form roller. A subtractive roller system removes excess ink from the form roller. For wash-up, the press drive and form roller are disengaged and the inking system is rotated by an inker roller drive while wash-up fluid is applied to the inking system.

The systems of U.S. Patent Publication No. US2001/0032559 work well under some printing conditions using some conventional inks. Under other conditions, some improvement is possible. For example, some undesirable "tinting" in the non-image areas has been observed to occur when the system is used with some standard inks formulated for multiple form roll applications.

SUMMARY OF PREFERRED EMBODIMENTS

The inking system disclosed herein employs at least two different rollers each in contact with the printing plate cylinder. The first or main form roller is the larger of the two and applies a film of ink to the image portions of the plate surface. The smaller of the two removes residual ink from non-image areas of the plate surface. A subtractive roller system, which contacts the main form roller, removes excess ink from the main form roller after printing. An applicator roller receives ink from an ink reservoir, and applies the ink to the main form roller.

Preferred embodiments of the present invention include a printing system having a rotating plate cylinder carrying a printing plate and a main form roller for applying ink to the printing plate. In accordance with this aspect of the invention the plate cylinder and the form roller are rotated at the same rpm so that the same areas on the form roller contact the same areas on the printing plate during each revolution of the plate cylinder. The plate cylinder and the form roller are configured to have somewhat different diameters and, thus, have different surface speeds at a nip formed there between. A second residual ink removing roller also contacts the printing plate. In preferred embodiments, this roller has a diameter less than half that of the main form roller. The system may also be equipped with the keyless, subtractive inking system. In operation the system is capable of producing a uniform ink film on the image area of the plate cylinder with essentially no tinting, ghosting, repeats, accumulation and starvation.

Other preferred embodiments of the present invention include systems for engaging and disengaging various of the rollers for different printing, clean-up and wash up modes.

More particularly, preferred embodiments of the present invention relate to an inking system for a printing system including a plate cylinder and, optionally, a blanket cylinder and impression cylinder. The inking system includes a large form roller rotationally contacting the printing plate at a nip and for applying ink to the printing plate. In preferred embodiments substantially all of the ink applied to the printing plate is applied by this form roller. A secondary roller or clean-up roller, relatively smaller than the form roller, also rotationally contacts the printing plate at a nip located between the nip formed by the form roller and the application of ink to the blanket cylinder. The diameter of the secondary roller is substantially smaller than the diameter of the form roller. The clean-up roller removes residual ink from non-image areas of the printing plate cylinder after ink has been applied to the printing plate by the form roller. An applicator roller rotationally contacts the main form roller for applying ink to the form roller. An associated ink subtractive system including at least one roller rotationally contacts the form roller for removing ink from the form roller.

In preferred embodiments the clean-up roller is friction driven at the speed of the printing system. The inking system advantageously includes a vibrator roller located so that the clean-up roller rotationally contacts the vibrator roller and the vibrator roller rotationally contacts the form roller, thus providing a path for ink transfer between the form roller and the clean-up roller.

In other preferred embodiments the form roller and the clean-up roller have resilient coverings. The form roller may have approximately the same diameter as the plate cylinder. The radius of the clean-up roller is less than half the radius of the main form roller. Advantageously, the plate cylinder and the form roller are rotated at about the same rpm so that the same areas on the form roller contact the same areas on the at least one printing plate during each revolution of the plate cylinder; and the plate cylinder and the main form roller have slightly different diameters such that they have surface speeds at a nip formed between the plate cylinder and the form roller which differ by greater than one foot per minute. The difference in surface speeds at the nip formed between the plate cylinder and the form roller is preferably between four and ten feet per minute.

The inking system of preferred embodiments of the present invention includes an ink subtractive system. This system may employ a resilient-surfaced transfer roller engaging the main form roller for removing excess ink from the form roller; a hard surfaced subtractive roller engaging the transfer roller for receiving excess ink from the transfer roller; and a scraper blade adjacent the subtractive roller for scraping excess ink from the subtractive roller. In these embodiments the inking system includes provision for rapid and effective wash-up to remove or change inks and further includes a mechanism for selectively disengaging the form roller and the clean-up roller from the printing plate cylinder. The form roller and clean-up roller are normally engaged with the printing plate during printing and the form roller and clean-up roller are selectively disengaged from the printing plate during wash-up.

As described below, the disclosure also relates to methods for inking and washing-up in printing press systems. Such systems involve steps including using a large form roller to apply ink to a printing plate removing residual ink from non-image areas of the printing plate with a clean-up roller which forms a nip with the printing plate cylinder, and removing excess ink from the form roller which forms a nip with a subtractive transfer roller. A vibrating roller may be positioned to form a first nip with the clean-up roller and a second nip with the form roller. The method may also include further wash-up steps involving the application of wash-up fluid and continuing to run the inking systems so that ink is removed from the applicator roller, form roller, vibrator roller and clean-up roller by the subtractive system.

The foregoing is intended to provide a convenient summary of the present disclosure. However, the invention intended to be protected is set forth in the claims hereof.

BRIEF DESCRIPTION OF THE DRAWINGS

Drawings of preferred embodiments of the invention are annexed hereto so that the invention may be better and more fully understood.

FIGS. 3(*a*) and 3(*b*) are details of the apparatus of FIG. 3.

DETAILED DESCRIPTION OF PREFERRED EMBODIMENTS

Figure 1:
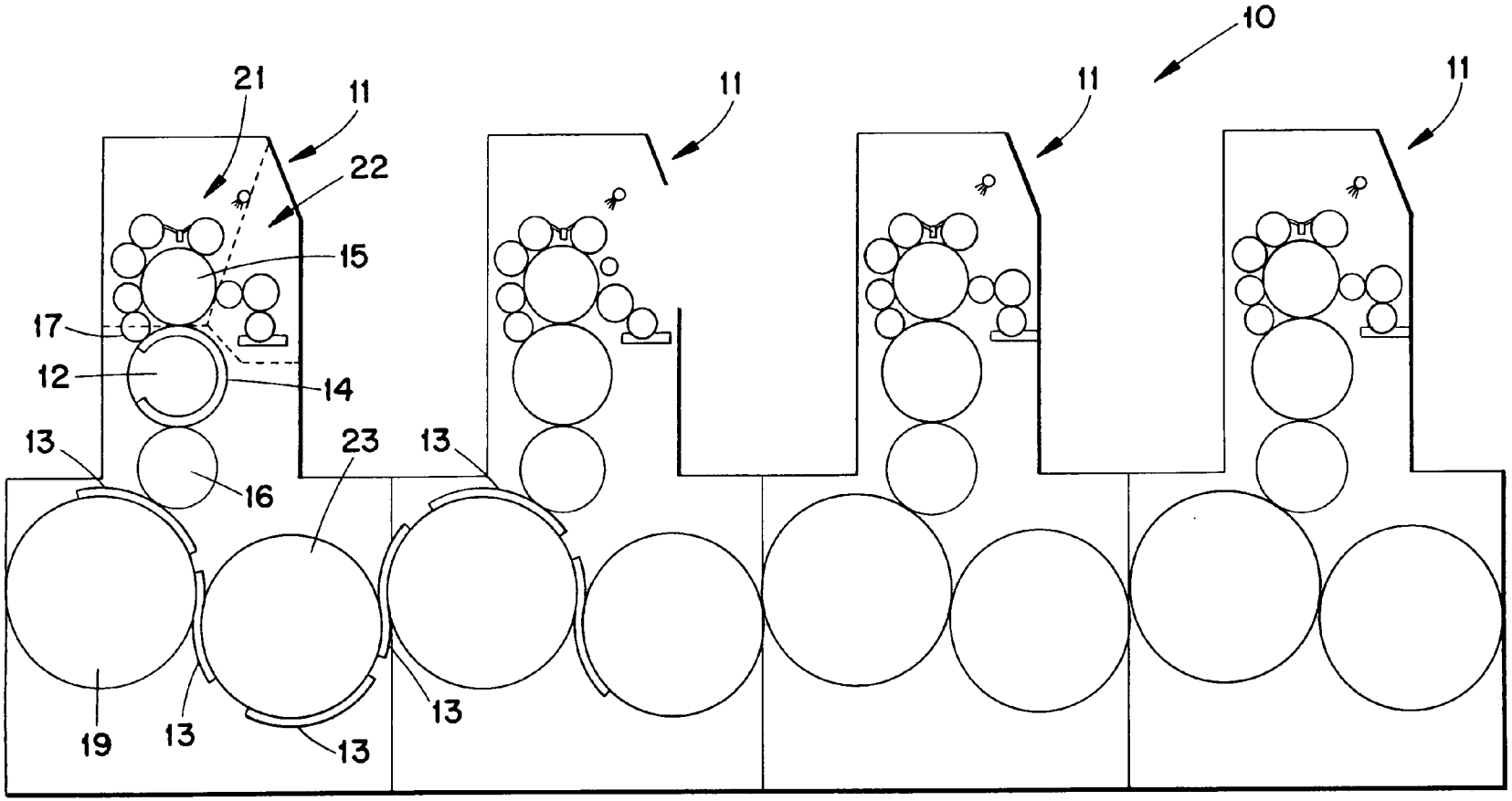
FIG. 1 is a diagrammatic view of a printing press having keyless inkers mounted thereon.

Referring to FIG. 1 of the drawings, the numeral 10 generally designates an offset printing press having a plurality of printing assemblies 11 for sequentially applying different color inks to media 13, such as paper, plastic, metal and the like, to produce a multi-colored printed product. The ink may be conventional ink, and as referred to herein, can also include a mixture of a conventional ink and dampening fluid.

Each printing assembly 11 includes a plate cylinder 12 carrying one or more printing plate 14 containing an image for printing on the media. The image (which may include text, graphics, pictures, etc.) is formed by image areas on the plate 14. The image areas receive ink from the inker 21 while the non-image areas are kept free of ink. These functions are performed by at least two rollers: a relatively large form roller 15 and a relatively smaller clean-up roller 17, each of which engages the plate cylinder 12.

Ink is applied to the printing plate 14 by the inker 21 to form a transferable inked image thereon corresponding to the image areas on the printing plate 14. The plate cylinder 12 may be rotated to engage the printing plate 14 with a rotatably mounted blanket cylinder 16, and transfer the inked image onto the blanket cylinder 16. The blanket cylinder 16 may then transfer the inked image to the media 13 which is pinched between the blanket cylinder 16 and an impression cylinder 19. A transfer cylinder 23 adjacent the impression cylinder 19 may be used to facilitate the transfer of the media 13 to an adjacent printing assembly 11 for applying a different color image to the media 13. Optionally, a dampener system 22 may be provided to apply dampening fluid to the large form roller 15.

Figure 2:
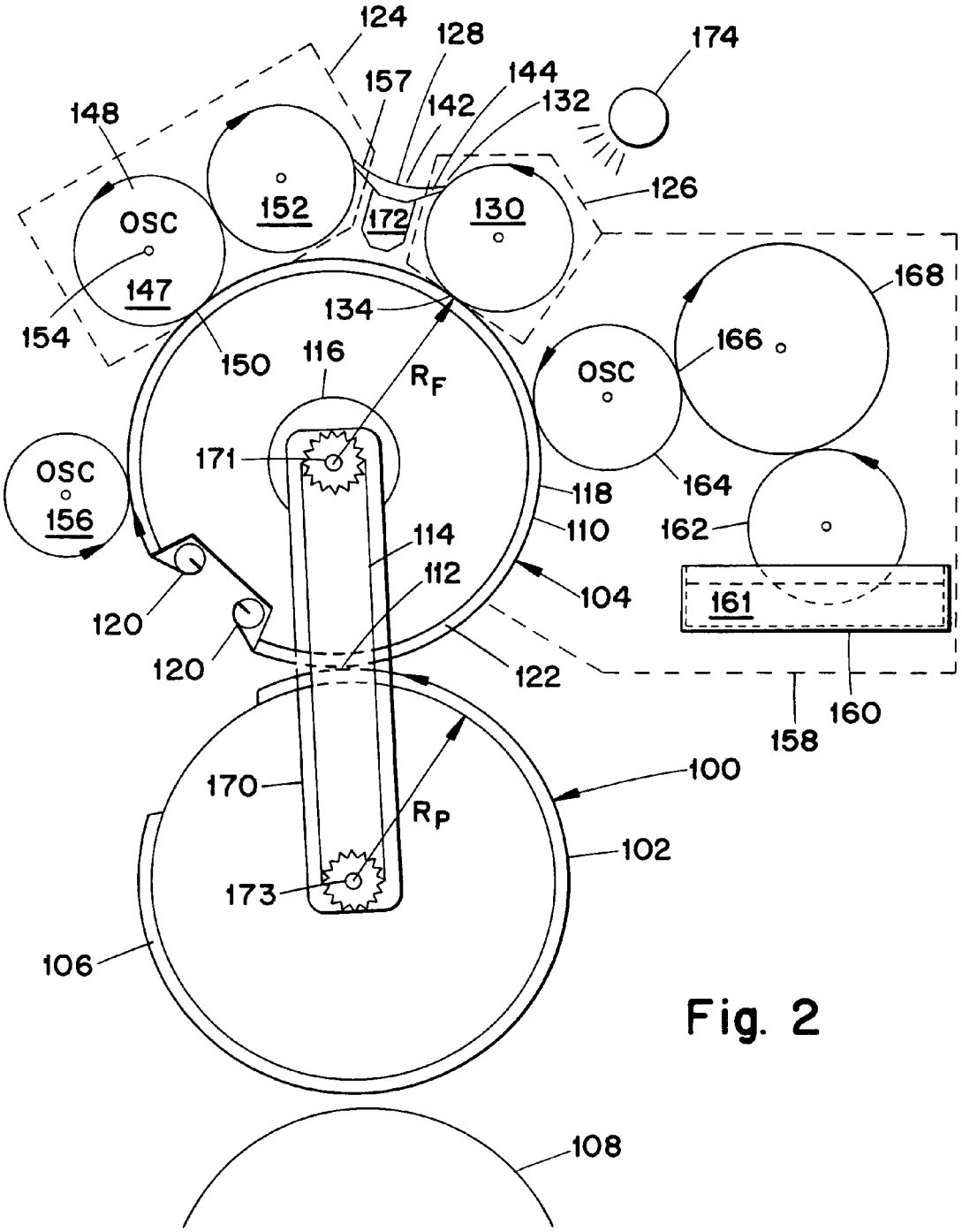
FIG. 2 is a diagrammatic view of a printing assembly with a keyless subtractive inker as shown in FIG. 9 of U.S. Patent Publication No. US2001/0032559.

A printing assembly described in U.S. Patent Publication No. US2001/0032559 is shown in FIG. 2. The embodiment as shown in FIG. 2 has one form roller and a subtractive roller system.

The printing assembly 100 includes a plate cylinder 102 and an inking system 104. In a printing process, one or more printing assemblies may be used to produce single or multi-color printed product. In the process an ink and/or a coating is applied by each of the printing assemblies. In offset printing, the plate cylinder 102 is rotated to engage one or more removable printing plates 106 with a rotatably mounted blanket cylinder 108. The blanket cylinder 108 then transfers inked image(s) to the media which is pinched between the blanket cylinder 108 [a portion of which is shown in FIG. 2] and an impression cylinder [such as shown in FIG. 1]. Sequential adjacent printing assemblies may be used for applying coatings or different color images to the media as previously described in connection with FIG. 1.

The inking system 104 may include a keyless, subtractive inking system using a form roller 110. The plate cylinder and the form roller have different diameters and have different surface speeds at a nip 112 formed between the plate cylinder and the form roller. The differential speed produces sharper printed images and tends to remove debris from the plate surface. It also tends to eliminate repeats and inker related streaks produced by conventional inkers. Advantageously, the difference in surface speeds at the nip 112 is greater than one foot per minute, for example, between four and ten feet per minute, as taught in the above-mentioned patent publication.

In preferred embodiments, the plate cylinder 102 and the form roller may be rotated at the same rpm, so that the same areas on the form roller contact the same areas on printing plate(s) 106 during each revolution of the plate cylinder. This may be accomplished by appropriate selection of conventional drives, for example, the chain coupled drive 114 and drive motor 116 shown in FIG. 2.

The rotation of the form roller and plate cylinder at the same rotational speed eliminates repeats or ghostings caused by a lack of registration between surfaces of the printing plate and the form roller. By employing the above described techniques, registration between the surfaces of the printing plate and the main form roller is achieved, thus minimizing this kind of ghosting and repeating. It will be understood, however, that such a system may cause a more rapid build up of ink in the areas on the main form roller. This problem may be addressed by use of a subtractive inking system such as described in the above-mentioned patent publication.

The difference in surface speeds is achieved by employing somewhat different radii for the form roller 110 and plate cylinder 102. These radii are represented in FIG. 2 as $R_F$ and $R_p$, respectively. Examples of these radii are $R_F$=7.820 inches and $R_p$=8.000 inches. Employing a form roller of comparable size to the plate cylinder results in a form roller larger than would normally be found in conventional inking systems using multiple form rollers. Accordingly, maintaining the form roller may create difficulties due to its size and the difficulty of removing such a large cylinder from the system for repair. In accordance with a preferred embodiment of the present invention, the form roller 110 has a removable covering 118 held in position by quick release mechanisms 120. A permanent, resilient under-layer 122 may also be employed.

The keyless subtractive inking system 104 of FIG. 2 will now be described. The inking system includes the form roller 110, an ink subtractive subsystem 124, an ink application subsystem 126 and an ink source such as a common ink reservoir 128.

The ink application system 126 may include an applicator roller 130 and a doctor blade 132. Ink on the applicator roller 130 is deposited on the form roller at nip 134. In preferred embodiments, the applicator roller 130 may be ceramic anilox roll of a type conventionally used in printing applications. The surface may be formed with ink carrying cells. Different application results may be produced by judicious selection of cell counts and cell depths. An example of a surface usable in the present invention has a cell count of 200 and cell depth of 35.64 $\mu$m.

In use, ink 142 maintained in the ink reservoir flows downward to ink fountain 144. The wiper blade 132 meters ink from the reservoir onto the applicator roller 130. Ink at the fountain is picked up by the applicator roller 130 and deposited onto the form roller 110.

The applicator roller 130 may be driven to rotate by a variable speed driver. The driver may be a variable speed motor, variable gear or belt drive or the equivalent. Varying the rotational speed of the applicator roller may be used to vary the amount of ink applied to the form roller, and ultimately the amount of ink applied to the printed media.

With continued reference again to FIG. 2, the ink subtractive system 124 may include a transfer roller 147 with a resilient surface or cover 148. The surface of the transfer roller contacts the surface of the form roller 110 at nip 150. Both surfaces move in the same direction at the nip 150 as shown by the circumferential arrows associated with the rolls. A subtractive roller 152 adjacent the transfer roller 147 receives excess ink from the transfer roller. The transfer roller 147 may be driven to oscillate in the direction of the axis 154 of rotation of the transfer roller 147 which is perpendicular to the plane of the figure. Such oscillation helps to prepare or "rough-up" the ink prior to subtraction. Vibrating roller 156 serves a similar purpose. Ink is removed from the subtractive roller 152 by blade 157.

The subtractive roller 152 may be driven to rotate by a variable speed driver. The driver may be a variable speed motor, variable gear or belt drive or the equivalent. Varying the rotational speed of the subtractive roller may be used to vary the amount of ink removed from roller after printing.

The system of FIG. 2 may optionally include a dampening system 158. When printing in a wet offset printing mode, a dampening system, such as, for example, the type commercially available from Epic Products International Corporation of Arlington, Tex., can be provided for applying a precisely metered film of dampening fluid to the surface of ink carried on the form roller 110. Such a dampener may comprise a pan 160 for containing the dampening fluid 161, and a resilient covered pan roller 162 pressure indented with a hydrophilic chrome roller 168, then rotated by a variable speed motor [not shown] to apply the necessary dampening fluid to the surface of the resilient covered form roller 110.

The apparatus of FIG. 2 is particularly well adapted for practicing efficient wash-up procedures, as now will be described. Assume first that the inking system 104 has been used to apply ink to the plate cylinder 102 as previously described. In a wash-up procedure, the form roller 110 may be disengaged from the plate cylinder 102. This permits rotation of the inking system rollers independently of the rotation of the press drive. While wash-up is performed, the plate cylinder may be accessed to clean and/or replace the plate for subsequent printing operations. A mechanism for disengaging the form roller and the plate cylinder is indicated schematically at 170. It may be constructed using conventional clutch and gearing mechanisms.

With continued reference to FIG. 2, during wash-up, excess ink may be removed from the ink reservoir 128. Alternatively, a removable ink unit 172 may be removed and replaced with the wash-up assembly. A conventional ink solvent or wash-up fluid may then be applied to the inking system. In one embodiment, the fluid may be applied to the applicator roller 130 using the spray bar 174. Alternatively or in addition, wash-up fluid may be sprayed on other of the rollers in the inking system. As the rollers of the inking system are rotated, a mixture of the wash-up fluid and residual ink on the rollers is gradually deposited in the reservoir. This mixture can be emptied or wiped up to complete the wash-up and prepare the system for charging with a new ink supply.

The wash-up process proceeds essentially automatically and harnesses the ink subtraction system to remove and collect the mixture. The wash-up procedure may be performed using a smaller amount of wash-up fluid relative to conventional wash-up processes, with consequential material savings and environmental benefits. Because the inking system is disengaged from the press drive and plate cylinder during wash-up, maintenance can be simultaneously performed on the press, plates may be cleaned and replaced, etc.

Figure 3:
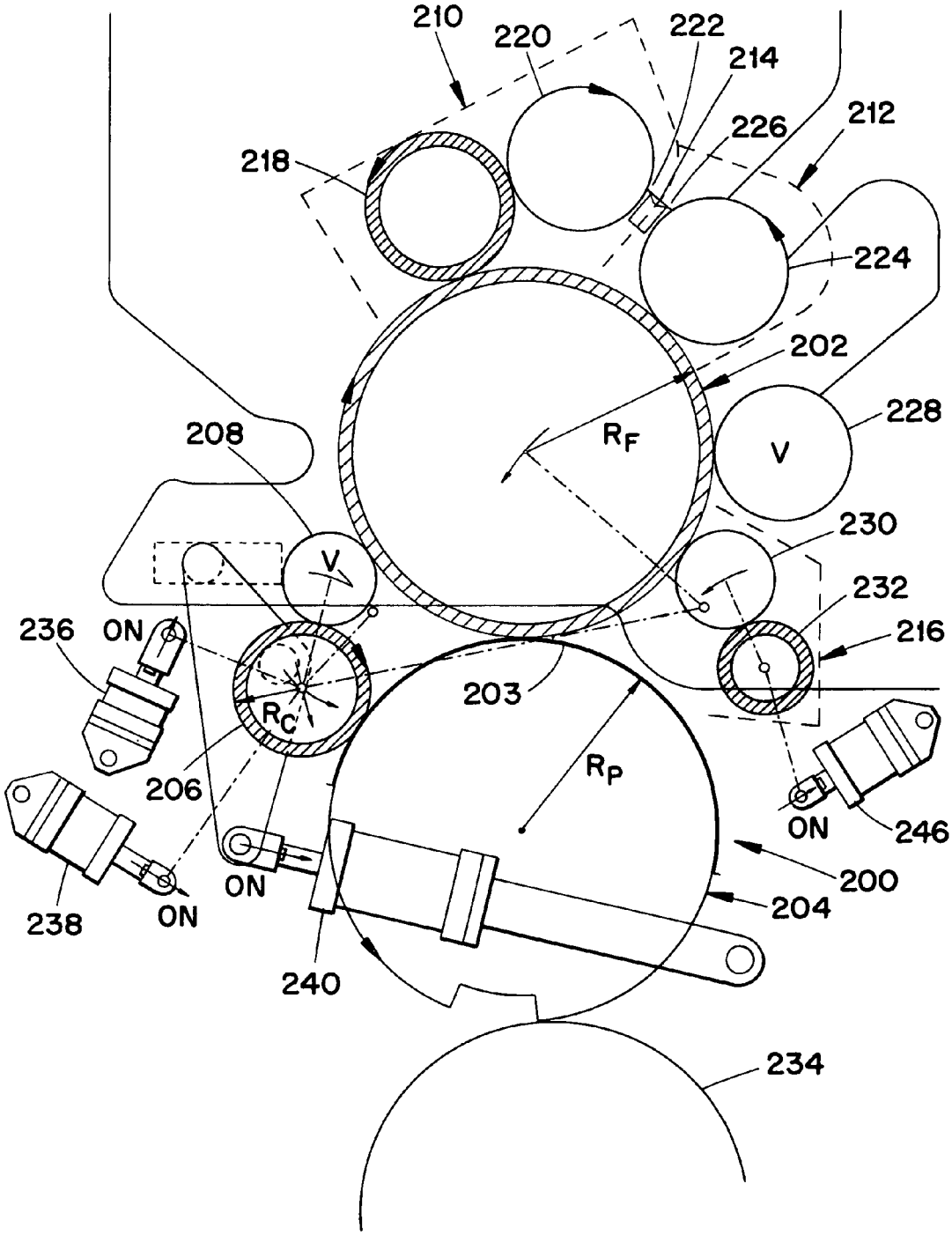
FIG. 3 is a diagrammatic view of a printing assembly of a preferred embodiment of the present invention in a first mode of operation.

FIG. 3 illustrates the printing assembly of FIG. 2, modified in accordance with aspects of the present invention to improve inker performance. The printing assembly 200 is particularly adapted for producing high quality, multi-colored sheet fed products. As in the embodiment of FIG. 2 a large or main resilient form roller 202 and plate cylinder 204 are employed. However, an additional roller 206, directly contacting the plate cylinder, is provided. This roller is a clean-up or residual ink removal roller. Both rollers 202 and 206 have a resilient covering (as indicated by the hatched rings in FIGS. 3 through 6). Preferably the covering materials are BUNA "N" for conventional inks, EPDM for U.V. inks. The clean-up roller 206 is shown in FIG. 3 as rotationally contacting the vibrator roller 208. Vibrator roller 208, in turn, engages the large or main form roller 202.

In preferred embodiments, the form roller 202 and plate cylinder 204 are rotated at the same rotational speed (rpm) but at different surface speeds to facilitate elimination of repeats or ghostings caused by a lack of registration between surfaces of the printing plate and the form roller. The difference in surface speeds is achieved by employing somewhat different radii to the form roller 202 and plate cylinder 204. These radii are represented in FIG. 3 as $R_F$ and $R_p$, respectively. Examples of these radii are $R_F$=7.820 inches and $R_p$= 8.000 inches. On the other hand, the clean-up roller 206 has a significantly smaller radius $R_c$, typically less than half the radius of the form roller 202. For example, a clean-up roller 206 with a radius $R_c$ of 3 inches may be used with the form roller described above with a radius $R_F$ of 7.820 inches and a plate cylinder with a radius $R_p$ of 8.000 inches.

The system of FIG. 3 may also employ an ink subtractive subsystem 210, an ink applicator subsystem 212, a common ink reservoir 214 and a dampening system 216 such as shown and described in connection with FIG. 2.

The ink subtractive system 210 may include a resilient-surfaced transfer roller 218 which engages the form roller 202 and removes excess ink therefrom. The transfer roller 218 transfers the removed ink to a smooth ceramic subtractive roller 220. Ink is removed from the subtractive roller 220 by blade 222 which may form part of an ink reservoir. In this way, removed ink is returned to the ink fountain for reuse. Alternatively, ink or ink and washup solution mixture may be removed by the subtractive system and pumped to a remote application system or discarded.

The ink application system 212 may include an application roller 224 driven to rotate in contact with the form roller 202. In one embodiment the application roller is an Anilox roller with a surface formed with non-interconnected, ink carrying cells. In another embodiment the application roller is formed with a continuous helical groove on its outer surface for carrying ink. Such a roller with groove 225 is shown in perspective in the detail of FIG. 3(*a*). The pitch of the groove (dimension d) may be, for example, 200 line CBM.

The driver for the application roller may be a variable speed motor, variable gear or belt drive or the equivalent. A wiper blade 226 may be used to meter the ink from the reservoir 214 onto the applicator roller 224. A vibrator roller 228 may be used to enhance the quality of the ink film applied by the application roller.

The printing system of FIG. 3 may also optionally include a dampening system 216. When printing in a wet offset printing mode, a damping system as described in connection with FIG. 2 may be employed, including a chrome roller 230 and metering roller 232.

In operation, ink from the application system 212 is supplied to form an ink film on the form roller 202. Ink is deposited on the image areas of the printing plate. The clean-up roller may have an ink film initially supplied by the large form roller 202 through vibrator roller 208, which has approximately the same ink film thickness as the ink film carried by the image areas of the plate cylinder after the plate has contacted the form roller. Under the known rules of ink transfer, little or no ink will be transferred from the clean-up roller to the image areas of the plate. However, if residual ink is present in the non-image areas of the printing plate in the form of tinting, the residual ink will be attracted to the thicker film on the clean-up roller 206 and removed from such non-image areas.

Following the clean-up roller nip, the ink film is deposited on the blanket cylinder 234 and, subsequently, to the sheet or web being printed. Following inking of the plate, ink film on the large form roller is again subjected, first, to the action of the subtractive roller system 210 and then receives a further application of ink by the ink application system 212.

Figure 3B:
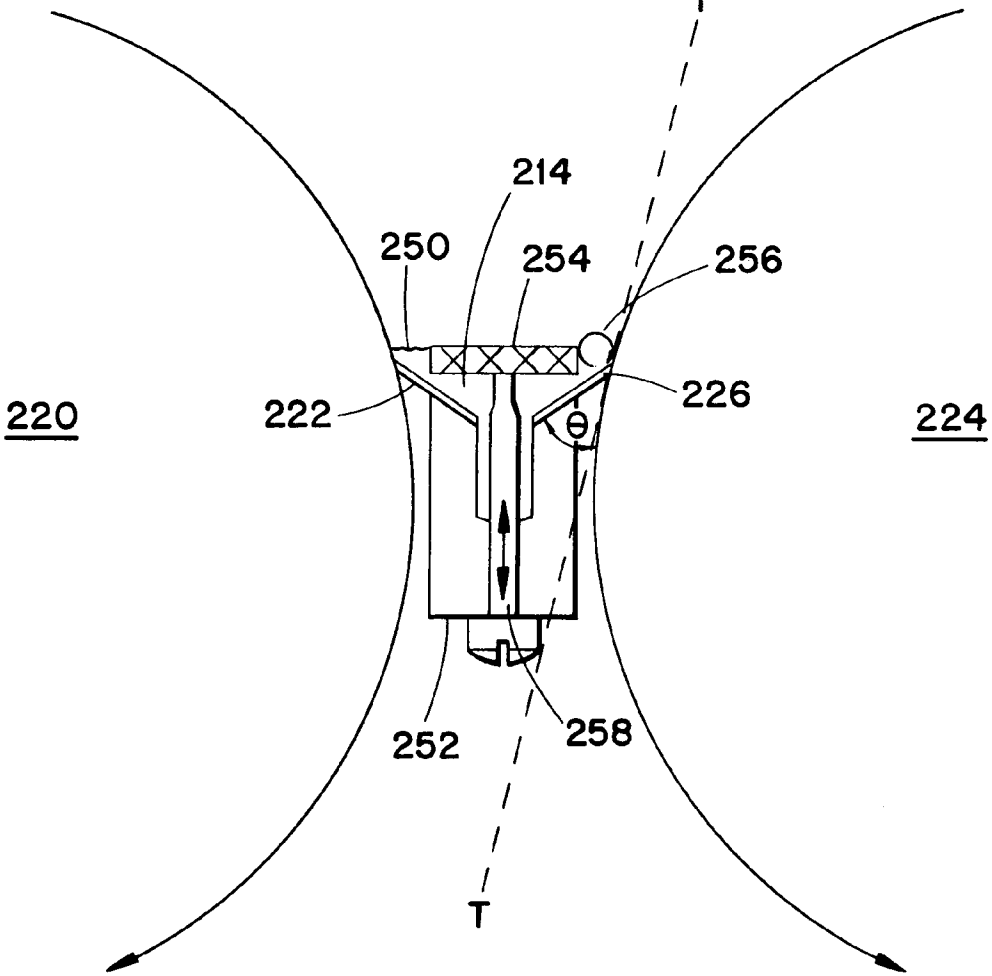
Figure 3A:
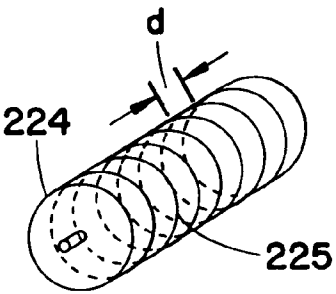

FIG. 3*b* illustrates a detail of a preferred embodiment of the system of FIG. 3. In FIG. 3*b* the applicator roller 224 is shown in contact with the wiper blade 226 which is used to meter ink from the reservoir 214. An ink level is shown at 250. The wiper blade has a line of contact with a cylindrical surface of the applicator roller. The wiper blade may be inclined downwardly at an acute angle θ with respect to the tangent T to the cylindrical surface of the applicator roller at the line of contact between the wiper blade and the cylindrical surface. Ink is removed from the subtractive roller 220 by the blade 222 which forms a part of the ink reservoir 214 as described above. A blade retainer 252 holds the blades 222 and 226.

In operation it has been noted that the rotational motion of the applicator roller 224 can cause the ink at the wiper blade 226 to form a rotating cylindrical volume which backs away from the applicator roller 224 causing ink starvation, particularly when the ink level in the reservoir is low. To overcome this problem, a baffle 254 may be provided. The baffle extends the length of the applicator roller (i.e., in a direction perpendicular to the plane of FIG. 3*b*). As shown, the baffle 254 prevents the rotating cylindrical volume of ink 256 from backing-away from the applicator roller 224, thereby preventing ink starvation. Advantageously, the baffle is adjustable in the vertical direction by means of an adjustment member 258, which permits the baffle to be located at a position which maintains good ink contact above the blade 226.

FIGS. 3 through 6 illustrate several modes of operation of the system first described in connection with FIG. 3. That system employs mechanisms for selectively engaging and disengaging various of the system rollers to achieve various results as described below. In FIGS. 3 through 6, the engagement systems are shown as implemented with four air cylinders and various cammed actuators for displacing axes of rotation of various rollers with respect to one another. It will be understood that various mechanical, hydraulic and electronic systems may be employed to achieve similar results.

Figure 4:
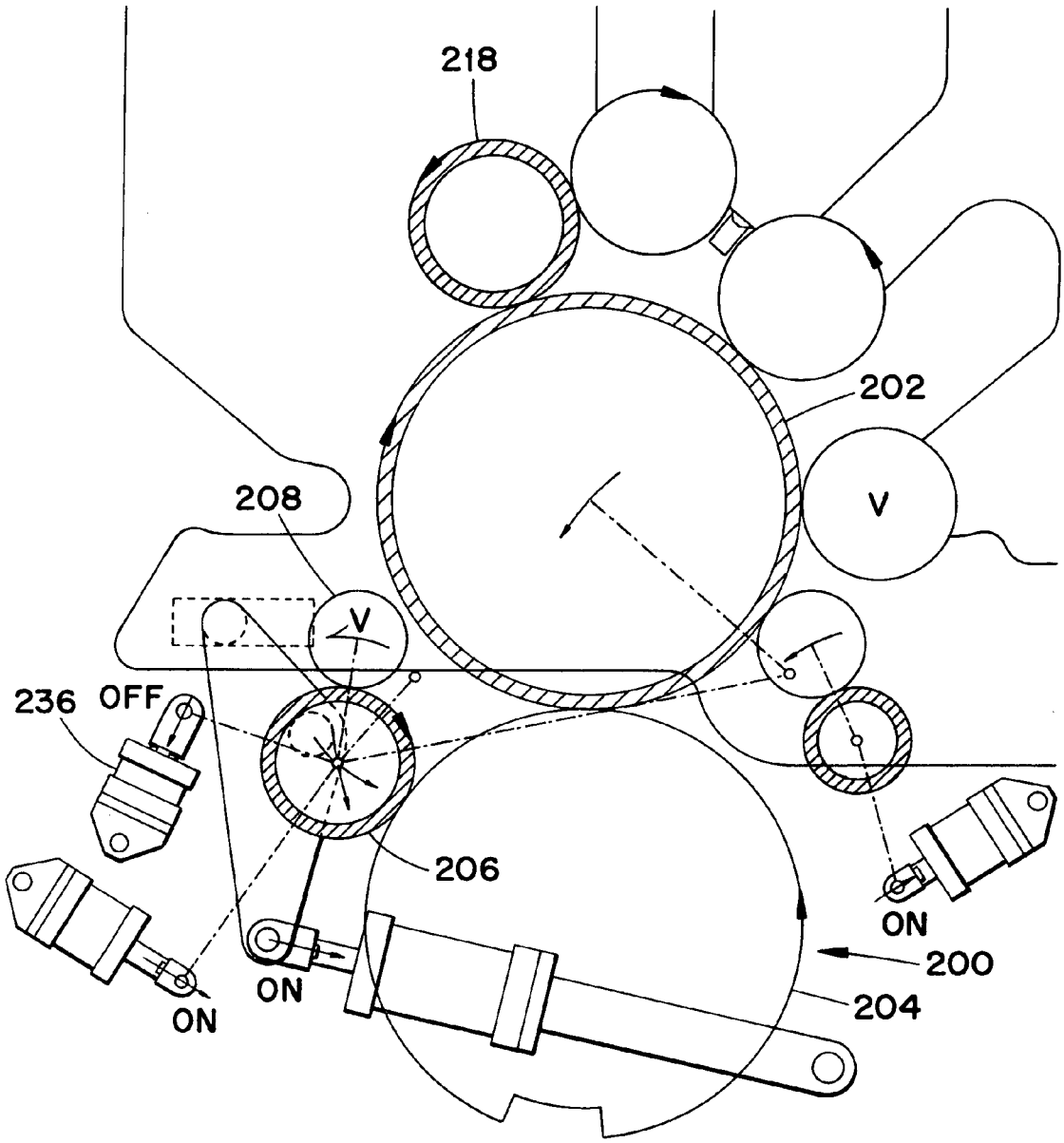
FIG. 4 is a diagrammatic view of the printing assembly of FIG. 3 in a second mode of operation.

As shown by comparing FIGS. 3 and 4, a first air cylinder 236 may be used to disengage vibrator roller 208 from the form roller 202. In this optional configuration, the clean-up roller 206 remains in contact with the printing plate 203 carried by the plate cylinder 204. In some printing operations with some inks, a better printed copy may be produced by this arrangement which eliminates ink transfer between the form roller 202 and clean-up roller 206 through the vibrator roller 208. In addition, the surface of the film of ink on the form roller 202 is no longer acted on by the vibrator roller 208 prior to being subjected to the subtractive transfer roller 218.

Figure 5:
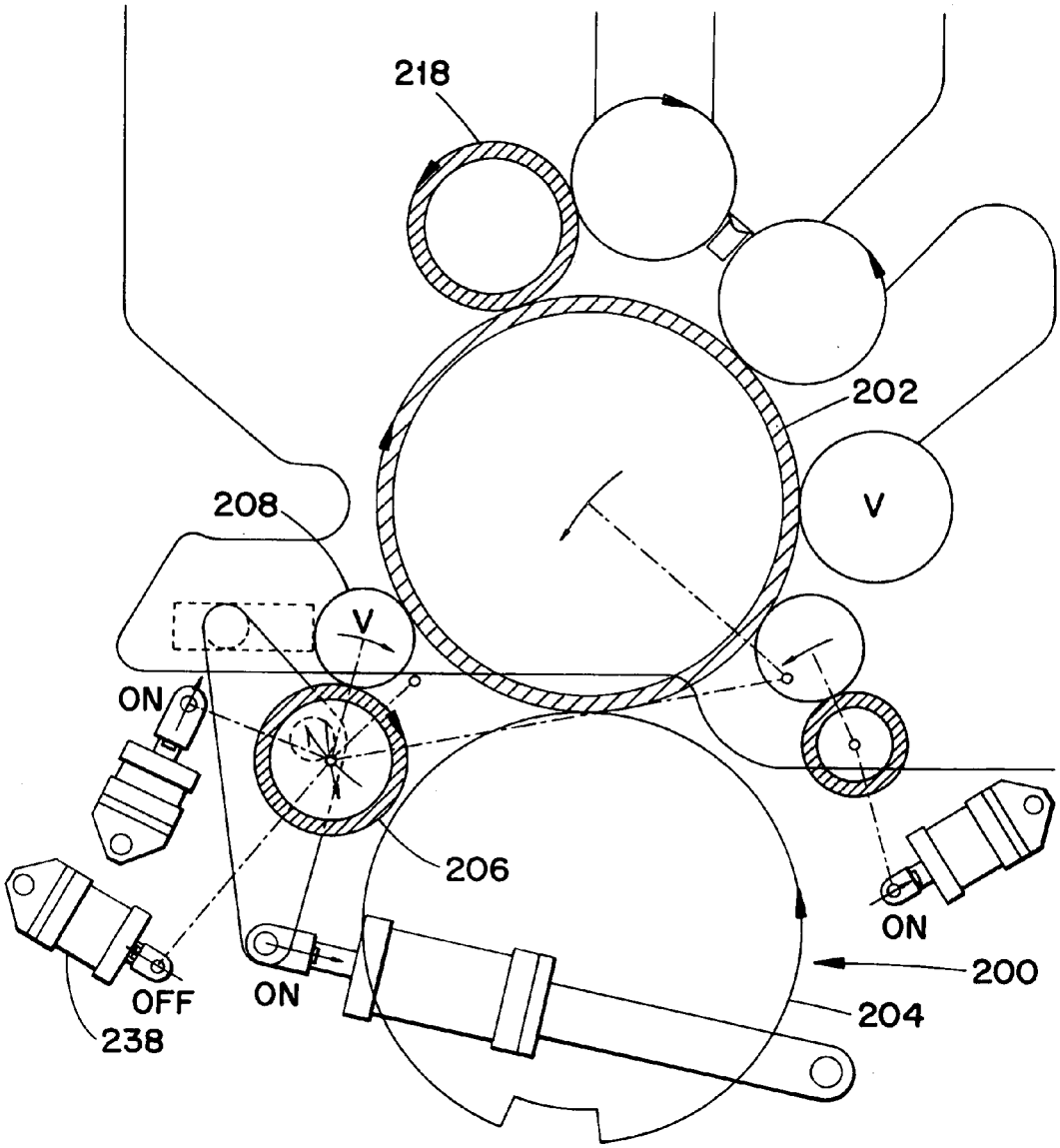
FIG. 5 is a diagrammatic view of the printing assembly of FIG. 3 in a third mode of operation.

As shown in FIG. 5, a second air cylinder 238 may be used to disengage the clean-up roller 206 from the plate cylinder, while the vibrator roller 208 remains in contact with the form roller 202. In some applications this may provide adequate printing. In this arrangement the vibrator roller is used to create a knap on the ink film carried by the form roller, which may make it easier for the subtractive transfer roller 218 to remove excess ink therefrom.

Figure 6:
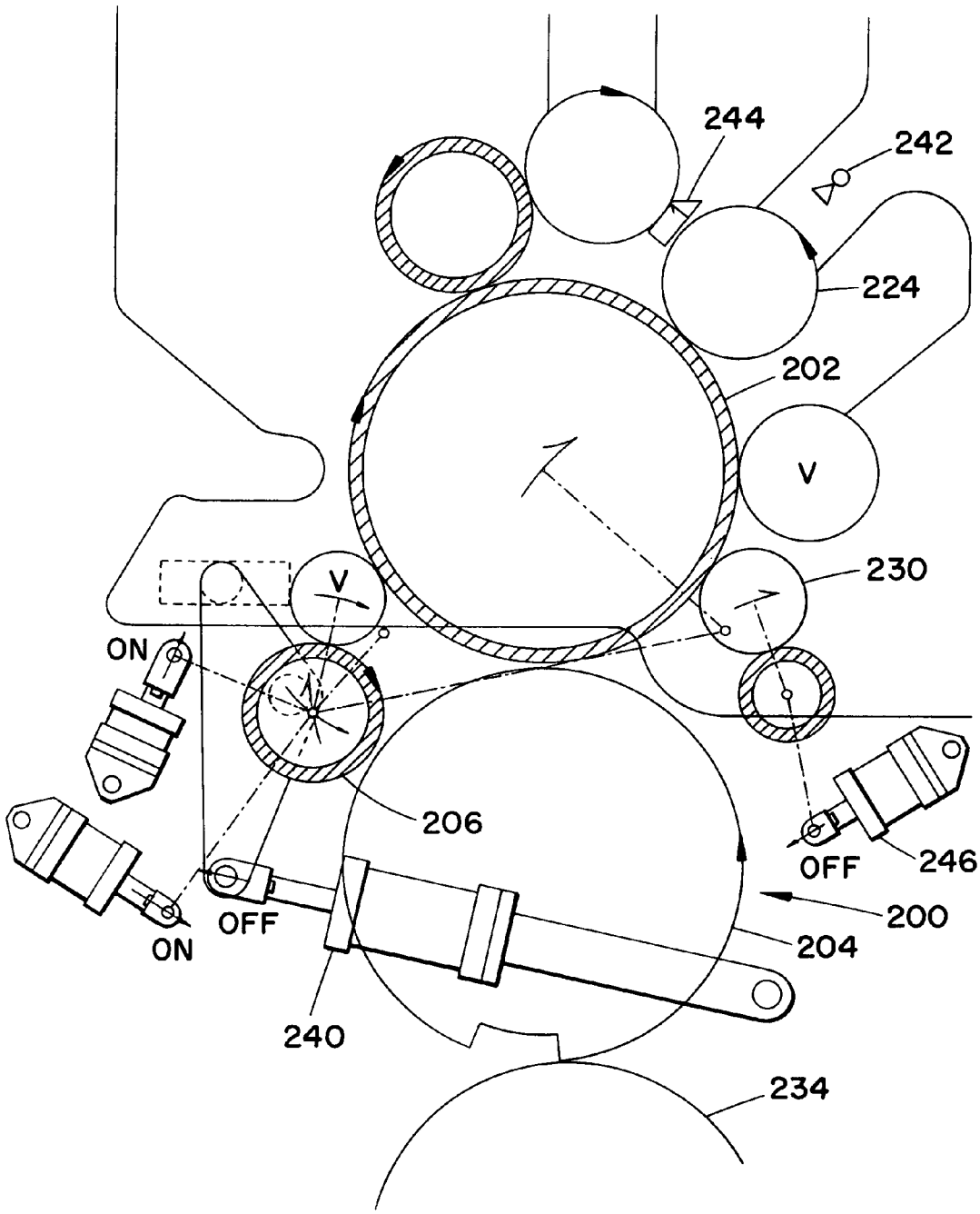
FIG. 6 is a diagrammatic view of the printing assembly of FIG. 3 in a fourth mode of operation.

As shown in FIG. 6, a third air cylinder 240 may be used to disengage the form roller 202 and clean-up roller from the plate cylinder 204. In this configuration, wash up may be performed as discussed above. Wash up fluid may be sprayed on the applicator roller 224 using the spray head 242. Ink and wash-up fluid mixture may be removed from the system including the clean-up roller 206 by the subtractive system and collected in a wash-up reservoir 244 which is used in place of the ink reservoir. Since the form roller and clean-up rollers are disengaged from the rest of the press, the plate cylinder may be wiped or "gummed" as wash-up proceeds. The blanket cylinder 234 may also be washed at this time.

A fourth air cylinder 246 may be used to disengage the chrome roller 230 of the dampening system from the form roller during clean-up or during printing operations not using dampening.

Figure 7:
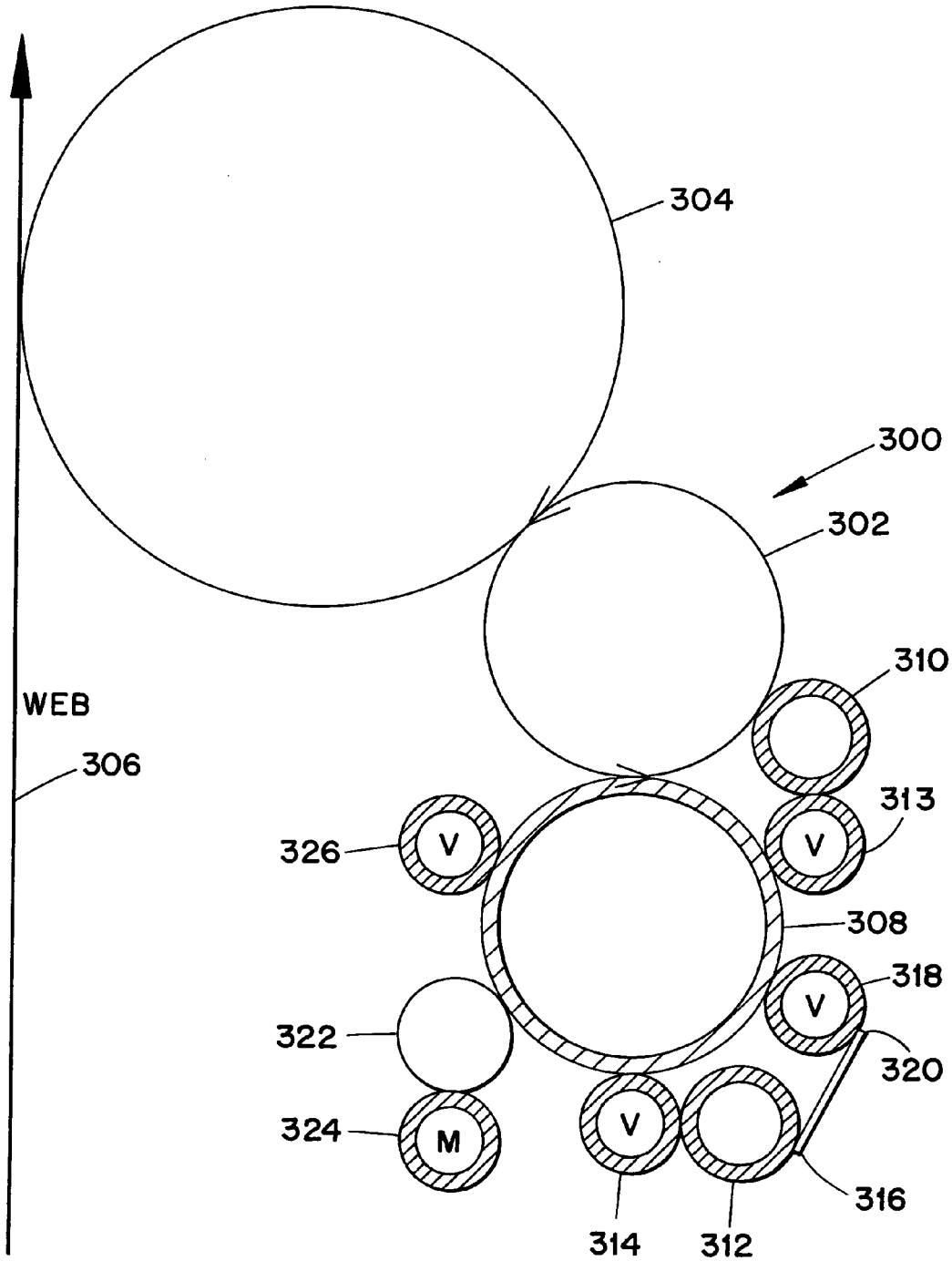
FIG. 7 is a diagrammatic view of a newspaper inker in accordance with an alternate embodiment of the present invention.

FIG. 7 is a diagrammatic view of a newspaper printing assembly 300 illustrating another embodiment of the present invention. The system includes a plate cylinder 302 and blanket cylinder 304 for printing on a continuous web 306.

The inking system in FIG. 7 includes a press-driven large or main form roller 308 and a clean-up roller 310, both of which contact the printing plate carried by the plate cylinder 302 to form a uniform film of ink on the image areas of the plate. A vibrator roller 313 engages both the clean-up roller 310 and the form roller 308 as shown. The form roller 308 and the clean-up roller 310 have a resilient covering.

Ink is applied to the form roller 308 by an applicator roller 312 through a vibrating distributor roller 314. The ink on the applicator roller is metered by a blade 316.

Ink is removed from the form roller 308 by a vibrating, variable drive subtractive roller 318. Ink is removed from the subtractive roller by a wiper 320 and recirculated to the applicator roller.

Dampening may be provided by chrome transfer roller 322 and metering roller 324. An additional vibrating roller 326 is provided to condition the ink film prior to its application to the printing plate.

The relative sizes and speeds of the plate cylinder 302, main form roller 308 and clean-up roller 310 are similar to that discussed above in connection with the embodiment of FIG. 3. In operation a uniform film of ink is applied to the printing plate by the main form roller 308 and residual ink is removed from non-image areas by the clean-up roller 310.

While there has been shown and described what are at present considered the preferred embodiment of the invention, it will be obvious to those skilled in the art that various changes and modifications can be made therein without departing from the scope of the invention.

We claim:

1. An inking system for a printing system including a plate cylinder carrying at least one printing plate comprising:

a form roller rotationally contacting the printing plate and for applying ink to the printing plate;

a secondary roller rotationally contacting the printing plate wherein the diameter of the secondary roller is substantially smaller than the diameter of the form roller;

an applicator roller rotationally contacting the form roller for applying ink to the form roller; and an ink subtractive system including at least one roller rotationally contacting the form roller for removing ink from the form roller.

2. The inking system of claim 1 wherein the secondary roller is a clean-up roller that removes residual ink from non-image areas of the printing plate after ink has been applied to the printing plate by the form roller.

3. The inking system of claim 2 wherein the clean-up roller is friction driven at the speed of the printing system.

4. The inking system of claim 2 wherein the clean-up roller is driven by a variable speed drive.

5. The inking system of claim 2 further comprising a vibrator roller and wherein the clean-up roller rotationally contacts the vibrator roller and the vibrator roller rotationally contacts the form roller.

6. The inking system of claim 2 wherein the form roller and the clean-up roller have resilient coverings.

7. The inking system of claim 2 wherein the form roller is approximately, but not exactly, the same diameter as the plate cylinder.

8. The inking system of claim 7 wherein the diameter of the clean-up roller is less than half the diameter of the form roller.

9. The inking system of claim 7 wherein the plate cylinder and the form roller are rotated at about the same rpm so that the same areas on the form roller contact the same areas on the printing plate during each revolution of the plate cylinder; and the plate cylinder and the form roller have slightly different diameters such that their surface speeds at a nip formed between the plate cylinder and the form roller differ by greater than one foot per minute.

10. The inking system of claim 9 wherein the difference in surface speeds at the nip formed between the plate cylinder and the form roller is between four and ten feet per minute.

11. The inking system of claim 1 wherein the ink subtractive system comprises:

a resilient-surfaced transfer roller rotationally contacting the form roller for removing excess ink from the form roller;

a hard surfaced subtractive roller driven by a variable speed drive, which subtractive roller rotationally contacts the transfer roller for removing excess ink from the transfer roller; and a scraper blade adjacent the subtractive roller for scraping excess ink from the subtractive roller.

12. The inking system of claim 1 further comprising means for selectively disengaging the form roller and the clean-up roller from the plate cylinder.

13. The inking system of claim 11 wherein the form roller and clean-up roller are normally engaged with the printing plate during printing and wherein the form roller and clean-up roller are selectively disengaged from the printing plate during wash-up.

14. The inking system of claim 2 wherein substantially all of the ink applied to the printing plate is applied by the form roller.

15. The inking system of claim 2 in combination with an offset printing system having a plate cylinder and a blanket cylinder and wherein the clean-up roller removes residual ink from non-image areas of the printing plate before the ink is applied by the printing plate to the blanket cylinder.

16. A method of inking one or more printing plates on a rotating plate cylinder comprising:

applying a film of ink to a form roller with an applicator roller:

transferring ink to a rotating printing plate at a nip between the form roller and printing plate;

removing residual ink from non-image areas of the printing plate with a clean-up roller at a nip between the clean-up roller and the printing plate; and removing excess ink from the form roller at a nip between the form roller and a subtractive roller system.

17. The method of inking of claim 16 further comprising the step of positioning a vibrating roller to form a first nip with the clean-up roller and a second nip with the form roller.

18. The method of inking of claim 16 wherein the form roller and plate cylinder are driven at surface speeds which differ by more than one foot per minute.

19. The method of inking of claim 16 wherein the clean-up roller and plate cylinder are driven at surface speeds which differ by more than one foot per minute.

20. The method of claim 16 further comprising disengaging the form roller and clean-up roller from the plate cylinder for wash-up operation.

21. The method of claim 20 further comprising:

applying wash-up roller solution to the application roller;

rotating the applicator roller, form roller, clean-up roller, and subtractive roller; and removing a mixture of ink and clean-up solution from the subtractive roller.

22. An inking system comprising:

a form roller for applying ink to a printing plate;

an applicator roller rotationally contacting the form roller for applying ink to the form roller;

a subtractive roller system including a subtractive roller and a blade in contact therewith for removing ink from the subtractive roller and depositing the removed ink in the ink reservoir;

a wiper blade forming at least a portion of an ink reservoir, the wiper blade contacting a cylindrical surface of the applicator roller to meter an ink film on the applicator roller, the wiper blade being inclined downwardly at an acute angle with respect to a tangent to the cylindrical surface of the applicator roller at a line of contact between the wiper blade and the cylindrical surface of the applicator roller; and a baffle located above the line of contract between the wiper blade and applicator roller for maintaining a volume of ink against the applicator roller.

23. The inking system of claim 22 further comprising means for varying a vertical location of the baffle to provide sufficient ink contact with the applicator roller.

24. The inking system of claim 22 wherein the cylindrical surface of the applicator roller rotates generally downwardly at the line of contact between the wiper blade and the applicator roller creating a rotating cylindrical volume of ink held in place by the baffle.

* * * * *